United States Patent [19]

Ishii et al.

[11] Patent Number: 4,932,230

[45] Date of Patent: Jun. 12, 1990

[54] KEY HOLDER

[75] Inventors: Susumu Ishii; Toshiaki Takizawa, both of Kurobe, Japan

[73] Assignee: Yoshida Kogyo K. K., Tokyo, Japan

[21] Appl. No.: 355,458

[22] Filed: May 23, 1989

[30] Foreign Application Priority Data

| | | | |
|---|---|---|---|
| May 24, 1988 | [JP] | Japan | 63-126151 |
| Jun. 1, 1988 | [JP] | Japan | 63-135093 |
| Jun. 9, 1988 | [JP] | Japan | 63-142457 |
| Dec. 14, 1988 | [JP] | Japan | 63-315753 |

[51] Int. Cl.[5] ..... A47G 29/10

[52] U.S. Cl. ..... 70/456 R; 70/68

[58] Field of Search ..... 70/68, 456–459, 70/57; 24/381, 385, 418

[56] References Cited

U.S. PATENT DOCUMENTS

| | | | |
|---|---|---|---|
| 3,127,618 | 4/1964 | Roach | 24/381 |
| 4,438,550 | 3/1984 | Oda | 70/68 |

FOREIGN PATENT DOCUMENTS

| | | |
|---|---|---|
| 0060461 | 9/1982 | European Pat. Off. . |
| 1042343 | 10/1953 | France . |
| 2509970 | 1/1983 | France . |
| 2024928 | 1/1980 | United Kingdom . |

*Primary Examiner*—Robert L. Wolfe

*Attorney, Agent, or Firm*—Hill, Van Santen, Steadman & Simpson

[57] ABSTRACT

A key holder includes a holding strap composed of a row of coupling elements attached to a flexible core cord, each of the coupling element having a coupling head which is symmetric in shape about a longitudinal axis of said coupling element, an end stop mounted across opposite ends of the holding strap for connecting them while keeping the holding strap bent into a closed loop with the respective coupling heads of the coupling elements directed inwardly of the looped holding strap, and a slider slidably mounted on and movable along opposed ones of the coupling elements for taking them into and out of interdigitating engagement. With this construction, the loop of the holding strap can be adjusted by moving the slider to such an extent as to meet the user's desire or to conform to the number of keys to be held on the key holder.

20 Claims, 19 Drawing Sheets

KEY HOLDER

BACKGROUND OF THE INVENTION

1. Field of the Invention

The present invention relates to a key holder for holding keys or the like articles in a bundled condition.

2. Description of the Prior Art

Various key holders are known, which comprise, as shown in FIG. 51 of the accompanying drawings, a closure link 1 connected to an end of a resilient C-ring 2 and adapted to extend between opposite ends of the C-ring 2 for closing an opening of the C-ring 2, thereby holding a key (not shown) on the C-ring 2, and an ornamental tab 4 connected to the closure link 1 by means of a connector strap 3.

The C-ring 2 of the conventional key holder is formed of a resilient strip of metal and in not adjustable in shape and size to conform to the number of keys to be held on the C-ring 2 or to meet a variety of user's desires.

As a consequence of the fixed shape and size, a large C-ring is needed when a large number of keys are to be held on the C-ring. Such large C-ring is not handy to carry but unsightly in appearance.

SUMMARY OF THE INVENTION

With the foregoing difficulties in view, it is an object of the present invention to provide a key holder which is variable in size and shape with the number of keys to be held on the key holder or at the user's desire.

Another object of the present invention is to provide a key holder which is handy to carry and sightly in appearance.

A further object of the present invention is to provide a key holder having a unique and fashionable design which provides a sense of amusing for the user.

According to the present invention, there is provided a key holder comprising: a holding strap composed of a row of coupling elements attached to a flexible core cord, each of the coupling elements having a coupling head which is symmetric in shape about a longitudinal axis of the respective coupling element; an end stop mounted across opposite ends of the holding strap for connecting them while keeping the holding strap bent into a closed loop with the respective coupling heads of the coupling elements directed inwardly of the looped holding strap; and a slider slidably mounted on and movable along opposed ones of the coupling elements for taking them into and out of interdigitating engagement to contract and expand the loop of the holding strap.

When the number of keys to be held on the key holder is small, the slider is moved in a direction away from the end stop to contract the loop of the holding strap. Conversely, when the number of keys to be held on the key holder is increased, the loop of the holding strip is enlarged by moving the slider toward the end stop.

Many other advantages and features of the present invention will become manifest to those versed in the art upon making reference to the detailed description and the accompanying sheets of drawings in which preferred structural embodiments incorporating the principles of the present invention are shown by way of the illustrative example.

DETAILED DESCRIPTION

Figure 1:
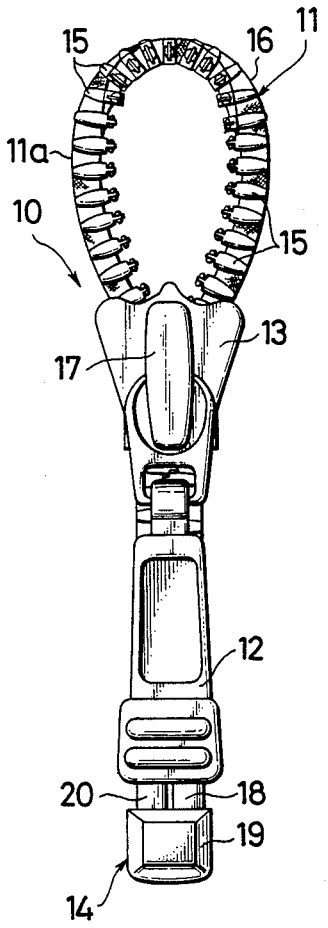
FIG. 1 is a front elevational view of a key holder according to the present invention.

The present invention will be described hereinbelow in greater detail with reference to certain preferred embodiments illustrated in the accompanying drawings. Like reference characters denote like or corresponding parts throughout several views.

Figure 2:
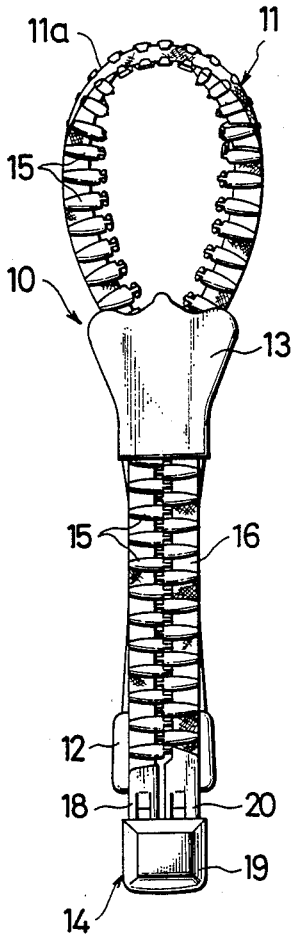
FIG. 2 is a rear view of FIG. 1.
Figure 3:
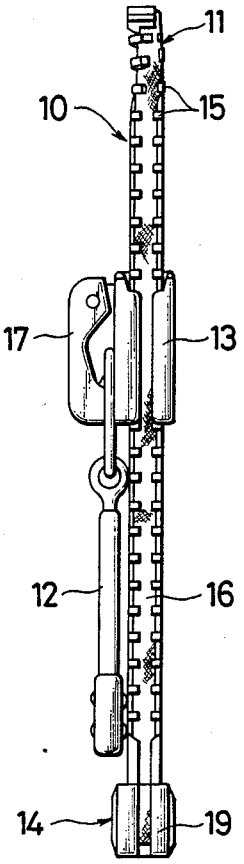
FIG. 3 is a right side view of FIG. 1.

FIGS. 1 through 3 show a key holder 10 according to a first embodiment of the present invention. The key holder 10 generally comprises a key holding strap 11, a slider 13 having a pull tab 12, a separable end stop 14 for releasably connecting opposite ends of the holding strap 11.

Figure 6:
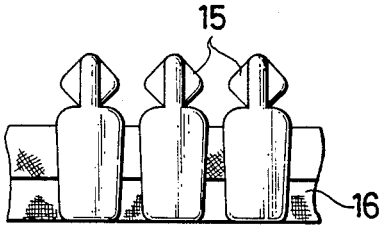
FIG. 6 is an enlarged fragmentary front elevational view of a part of the key holder showing coupling elements.
Figure 7:
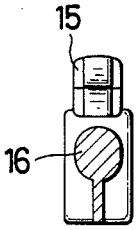
FIG. 7 is a side view of FIG. 6.
Figure 8:
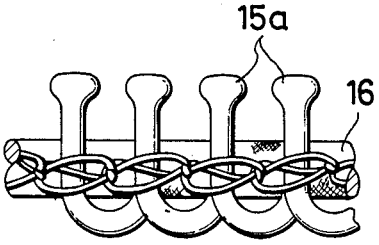
FIG. 8 is a view similar to FIG. 6, but showing a coiled filamentary coupling elements.
Figure 9:
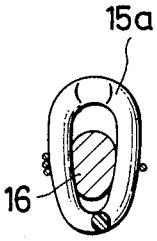
FIG. 9 is a side view of FIG. 8.
Figure 10:
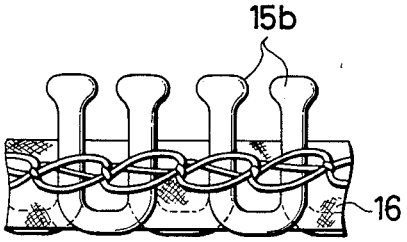
FIG. 10 is a view similar to FIG. 6, but showing a zigzag filamentary coupling elements.
Figure 11:
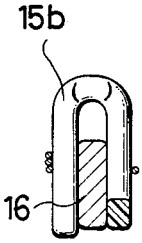
FIG. 11 is a side view of FIG. 10.
Figure 12:
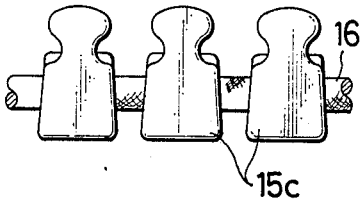
FIG. 12 is a view similar to FIG. 6, but showing coupling elements injection-molded of synthetic resin.
Figure 13:
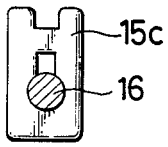
FIG. 13 is a side view of FIG. 12.
Figure 14:
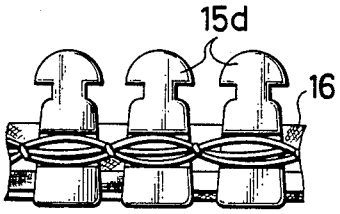
FIG. 14 is a view similar to FIG. 12, but showing coupling elements extrusion-molded of synthetic resin.
Figure 15:
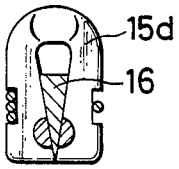
FIG. 15 is a side view of FIG. 14.

The holding strap 11 is composed of a row of discrete coupling elements 15 attached to a flexible core cord 16 at equal intervals. Each of the coupling elements 15 has a coupling head (not designated) which is symmetric in shape about a longitudinal axis of the respective coupling element 15, as shown in FIG. 6. Stated more specifically, the coupling head has a projection on each side of the coupling element 15. The coupling elements 15 are mode of metal and attached by die-casing to the core cord 16 astride of the core cord 16, as shown in FIG. 7. The coupling elements 15 may be replaced with a row of coiled coupling elements 15*a* formed from a continuous thermoplastic monofilament and attached to a core cord 16 by sewing stitches (not designated) with the core cord 16 extending through the coiled coupling elements 15*a*, as shown in FIGS. 8 and 9. Alternatively, it is possible to use a row of zigzag coupling elements 15*b* mounted astride the core cord 16 as shown in FIGS. 10 and 11, the zigzag coupling elements 15*b* being formed from a continuous thermoplastic monofilament and attached to a core cord 16 by sewing stitches. FIGS. 12 and 13 show a modified form of the coupling elements. The coupling elements 15*c* are formed of a synthetic resin injection-molded on a core cord 16. As a further alternative, a row of coupling elements 15*d* extrusion-molded of a synthetic resin can be used as shown in FIGS. 14 and 15.

Figure 16:
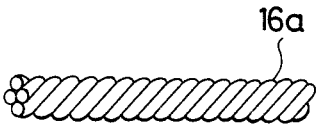
FIG. 16 is a perspective view of a core cord of twisted yarn.
Figure 17:
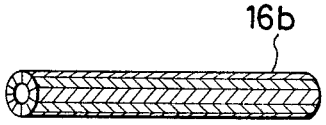
FIG. 17 is a view similar to FIG. 16, but showing a knit core cord.
Figure 18:
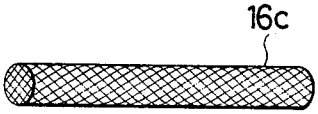
FIG. 18 is a view similar to FIG. 16, but showing a core cord formed of a woven flexible wire.
Figure 19:
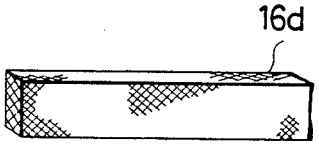
FIG. 19 is a view similar to FIG. 16, but showing a woven fabric blade.

Examples of the flexible core cord 16 may include a fabric cord 15*a* of twisted yarn (FIG. 16), a knit fabric cord 16*b* (FIG. 17), a flexible woven wire 16*c* (FIG. 18) and a woven fabric blade 16*d* (FIG. 19).

As shown in FIGS. 1 and 3, the slider 13 preferably has a lock mechanism 17 for locking the slider 13 in position against movement relative to the row of coupling elements 15, thereby protecting an accidental separation of the interengaged coupling elements 15. The slider lock mechanism 17 may be of the autolock type including a spring-viased locking prong normally urged into engagement with one of the coupling elements 15, the semi-autolock type including a locking element in the form of a cam or a pin which is movable into and out of interlocking engagement in response to an angular movement of the pull tab, or a notch lock slider. The structural details of the slider lock mechanism 17 will be described later on.

The separable end stop 14 is composed of a retainer pin 18 secured to one of opposite ends of the holding strap 11 and having a retainer box 19 connected thereto, and a separable pin 20 secured to the other end of the holding strap 11 and releasably receivable in the retainer box 19 for detachably connecting the opposite ends of the holding strap 11 while the strap 11 is being bent into a closed loop 11*a*, with the coupling heads of the respective coupling elements 15 directed inwardly of the cooped holding strap 11.

The individual coupling elements 15, the slider 13 and the separable end stop 14 are all made of metal and plated with a nickel or a material which provides a coated layer of gold color or silver color. The key holder 10 having such plated components 15, 13, 14 is attractive in appearance.

Figure 4:
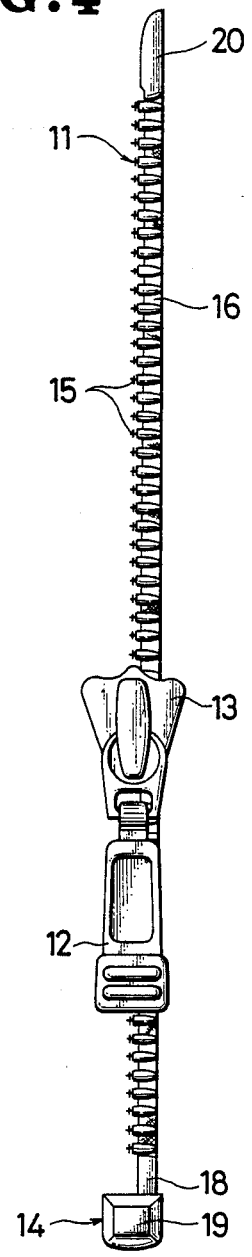
FIG. 4 is a front elevational view of the key holder as it is in a releasing position.
Figure 5:
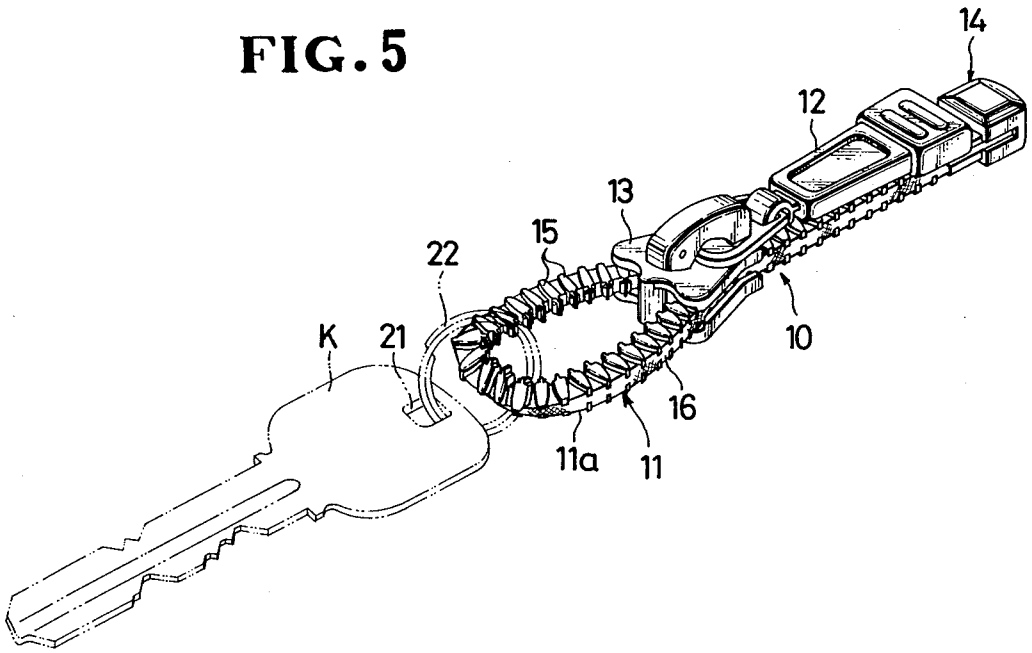
FIG. 5 is a perspective view of the key holder as it is in a holding position.

The key holder 10 of the foregoing construction operates as follows. The slider 13 is moved in a direction to disengage opposed ones of the coupling elements 15 on the looped holding strap 11 until it abuts on the retainer box 19. While keeping the slider 13 on the retainer box 19, the separable pin 20 is released from the retainer box 19 through the slider 13 to thereby disengage or separate the opposite ends of the holding strap 11. The holding strap 11 is thus allowed to extend linearly as shown in FIG. 4. Then with the separable pin 20 directed forwardly, the holding strap 11 is threaded through a key hole 21 in a key K or through a split key ring 22 attached to the key K. The separable pin 20 is inserted through the slider 13 into the retainer pin 19 to connect the opposite ends of the holding strap 11 for completing the loop 11*a* of the holding strap 11. Then the slider 13 is moved away from the separable end stop 14 to a desired extent to thereby hold the key K on the holding strap 11 of the key holder 10, as shown in FIG. 5. The degree to which the loop 11*a* of the holding strap 11 is enlarged or contracted can be adjusted depending upon the extent of movement of the slider 13 so as to conform to the number of keys to be held on the key holder 10 or to meet the user's desire. The key holder 10 is therefore handy to carry and sightly in appearance.

Figure 20:
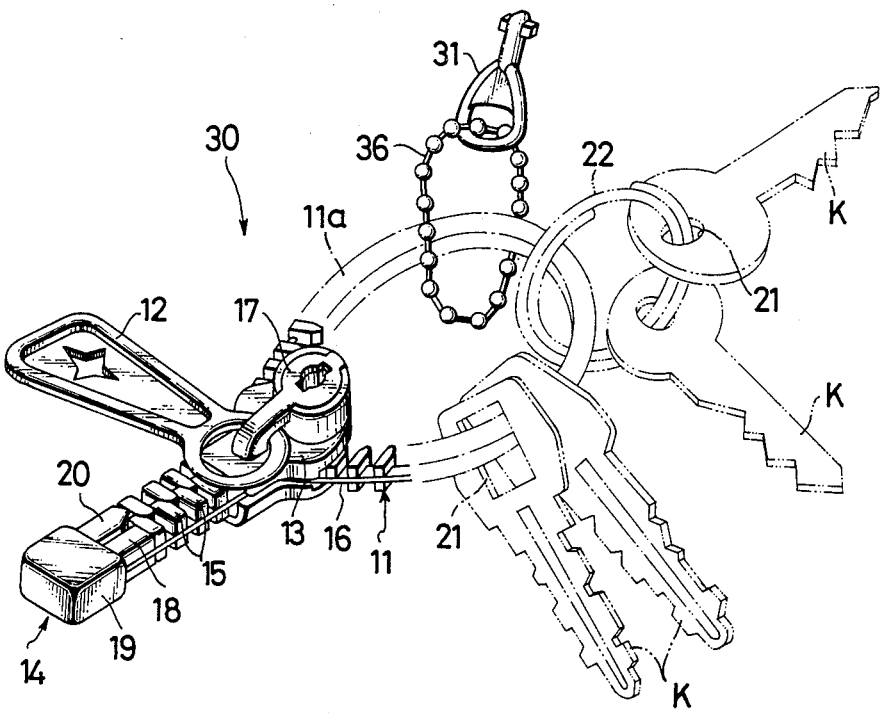
FIG. 20 is a perspective view of a key holder according to another embodiment of the present invention.

FIG. 20 shows a modified form of the key holder according to the present invention. The modified key holder 30 is substantially the same as the key holder 10 shown in FIG. 1, excepting that the slider lock mechanism 17 is of the key-lockable type. The key-lockable slider lock mechanism 17 includes a key 31, a cylinder 32 rotatably mounted on a body of the slider 13 and having a keyhole in which the key 31 is received, and a compression coil spring 33 disposed in the slider body and acting between the slider body and an end of an elongate locking strip 34 to urge the end of the locking strip 34 against a recessed cam surface of the cylinder 32, the locking strip 34 having a locking prong 35 at an opposite end thereof.

Figure 21:
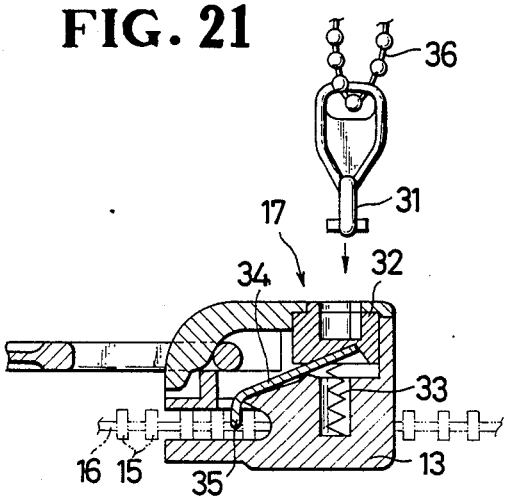
FIG. 21 is a cross-sectional view showing a locking mechanism associated with a slider of the key holder shown in FIG. 20.

To lock the slider 13 in position against movement relative to the coupling elements 15, the key 31 is inserted into the keyhole in the cylinder 32 and then turned to rotate the cylinder in either direction, thus causing the locking strip 34 to be pivoted by the cam surface on the cylinder 32 in a direction to move the locking prong 35 into interlocking engagement with one of the coupling elements 15, as shown in FIG. 21. When the slider 13 is to be unlocked, the cylinder 32 is turned by the key 31 through an angle of 180° from the position shown in FIG. 21 to a position shown in FIG. 22 whereupon the locking strip 34 is pivoted upwardly about the cam surface on the cylinder 32 to thereby disengage the locking prong 35 from the coupling element 15. The slider 13 is thus allowed to move relative to the coupling element for contracting or expanding the loop 11*a* of a holding strap 11. The key 31 is connected with a key chain 36 adapted to be threaded over the loop 11*a* of the holding strap 11 so that the missing of the key 31 can be prevented.

Figure 24:
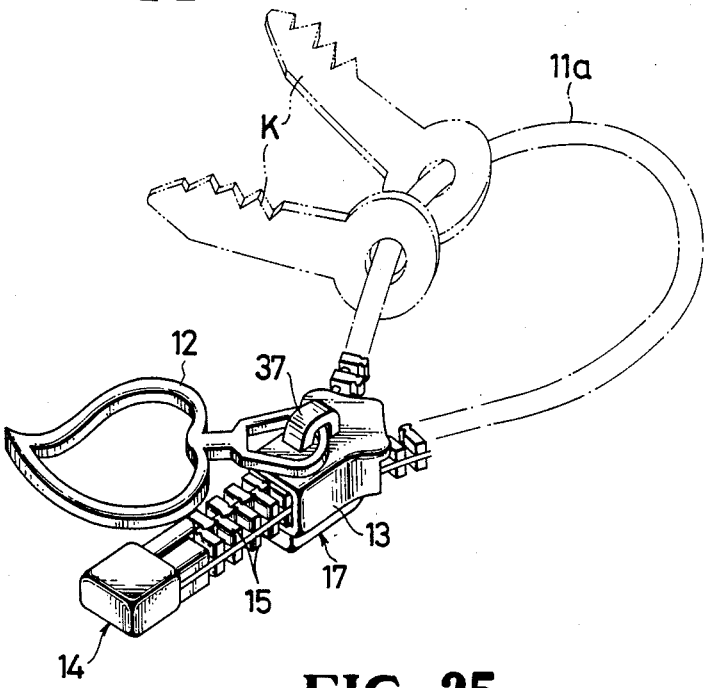
FIG. 24 is a perspective view of a key holder having a modified slider locking mechanism.
Figure 25:
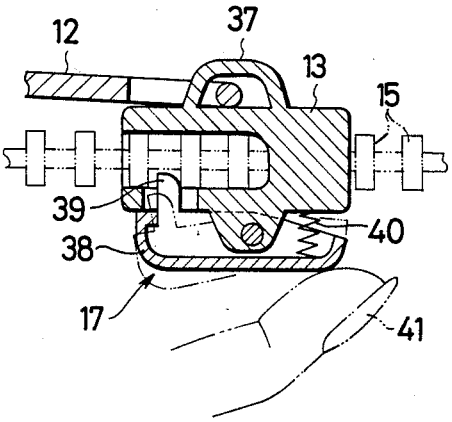
FIG. 25 is a cross-sectional view illustrative of the manner in which the slider locking mechanism operates.

A modified slider lock mechanism 17 shown in FIGS. 24 and 25 is disposed on the underside of a slider 13. As a result, the slider 13 includes an ornamental pull tab 12 pivotally connected to an arcuate support lug 37 disposed on the upper surface of a slider body. The slider lock mechanism 17 comprises a pivotable cover 38 pivotally mounted on the underside of the slider body and having a locking prong 39 at its one end, and a compression coil spring 40 disposed in the cover 38 and acting between the slider body and the cover 38 to urge the latter clockwise in FIG. 25. Thus, the locking prong 39 is normally brought into interlocking engagement with one of the coupling elements 15 to thereby lock the slider 13 in position against movement relative to the coupling elements 15. To release or unlock the slider 13, the cover 38 is manually pressed by the user's finer to turn counterclockwise against the force of the spring 40 until the locking prong 39 is disengaged from the coupling element 15. While keeping the cover 38 and the locking prong 39 in the respective unlocking positions illustrated in the phantom lines in FIG. 25, the pull tab 12 is pulled to move the slider 13 along opposed ones of the coupling elements 15 for expanding and contracting the loop 11*a* (FIG. 24) of a holding strap 11.

Figure 26:
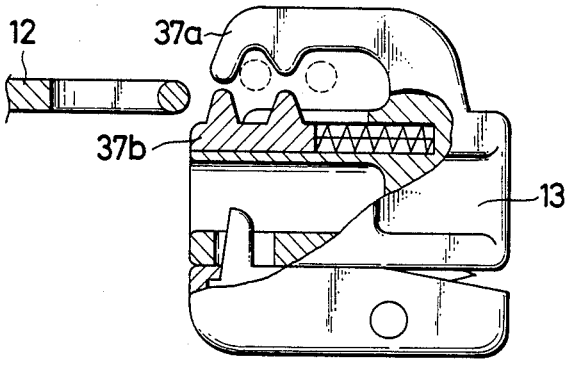
FIG. 26 is a side view, partly in cross section, of a modified slider having a detachable pull tab, the view showing the pull tab detached from a slider body.
Figure 27:
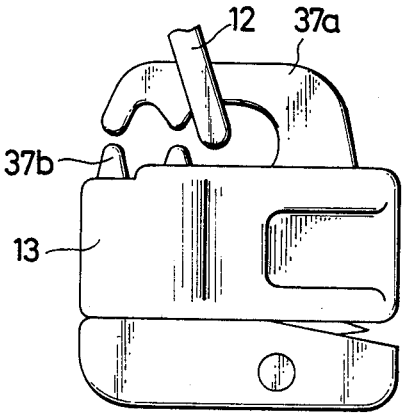
FIG. 27 is a side view of the slider shown in FIG. 26, the view showing the pull tab attached to the slider body.

The pull tab 12 connected to the arcuate support lug 37 is not detachable from the slider body. The pull tab may be detachable connected to a support lug of the slider body in which instance the support lug comprises an arch-shaped lug 37*a* extending from the front end toward the rear end of an upper plate of the slider body and terminating in a downwardly bent end which is spaced from the upper plate by a gap for the passage therethrough of a spindle of the pull tab when the pull tab 12 is attached to or detached from the slider body. The slider 13 includes a spring-loaded pull tab retainer 37*a* slidably mounted on the upper plate of the slider body. The pull tab retainer 37*b* is movable between a pull tab retaining position to substantially close the cap for preventing the detachment of the pull tab 12 from the lug 37*a*, and a pull tab releasing position to open the gap for allowing the detachment of the pull tab 12 from the lug 37*a*. The pull tab retainer 37*b* is normally urged in the pull tab retaining position shown in FIG. 26. The pull tab 12 may be replaced to another ornamental pull tab at the user's desire.

Figure 22:
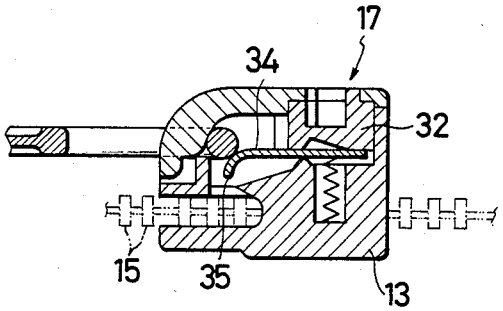
FIG. 22 is a view similar to FIG. 21, but showing the locking mechanism in a releasing or unlocking position.
Figure 28:
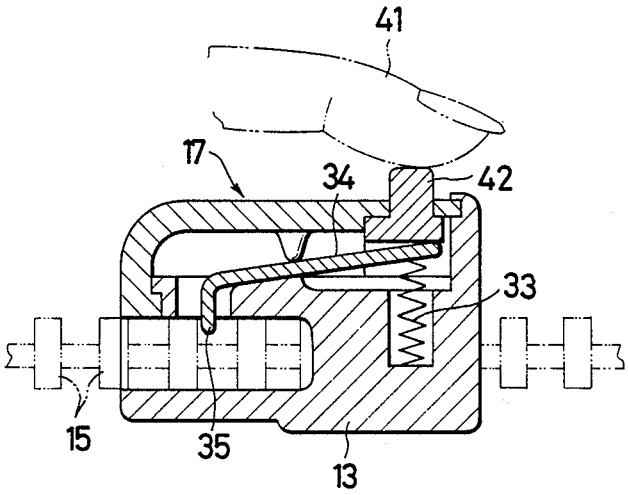
FIG. 28 is a cross-sectional view of another slider locking mechanism with parts in a locking position.
Figure 29:
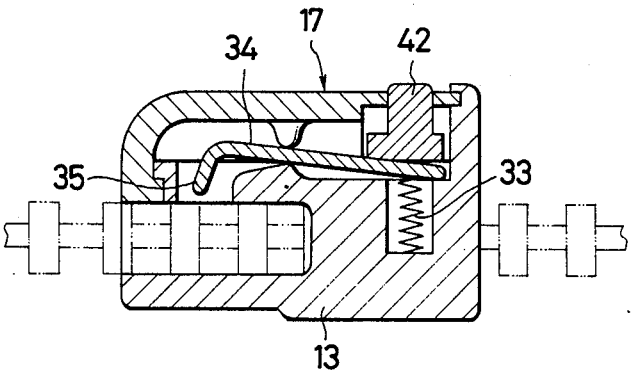
FIG. 29 is a view similar to FIG. 28, but showing the locking mechanism with parts in an unlocking position.

FIGS. 28 and 29 show a modified slider lock mechanism 17 of the autolock type. The slider lock mechanism 17 is similar to the lock mechanism shown in FIGS. 21 and 22 but differs therefrom in that it includes a manually operated unlock knob 42 instead of the rotatable cylinder 32. The unlock knob 42 is normally urged upwardly by a compression coil spring 33 with an end of an elongate locking strip 34 held between the unlock knob 42 and the spring 33 so that a locking prong 35 on an opposite end of the locking strip 34 projects into a space between two adjacent coupling elements 15 to thereby lock the slider 13 in position against movement relative to the coupling elements 15, as shown in FIG. 21. To unlock the slider 13, the unlock knob 42 is depressed by the user's finger 41 to cause the locking strip 34 to turn clockwise about an intermediate portion thereof, thereby releasing the locking prong 35 from interlocking engagement with the coupling element 15, as shown in FIG. 22. While keeping the unlock knob 42 in this depressed unlock position, the slider 13 is moved along opposed ones of the coupling elements 15.

Figure 30:
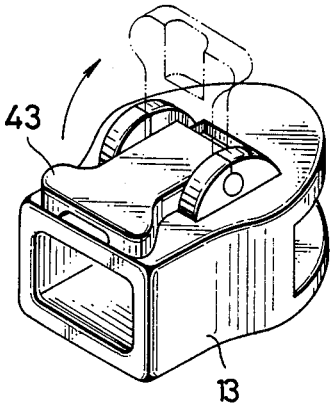
FIG. 30 is a perspective view of a slider having a modified locking mechanism.
Figure 31:
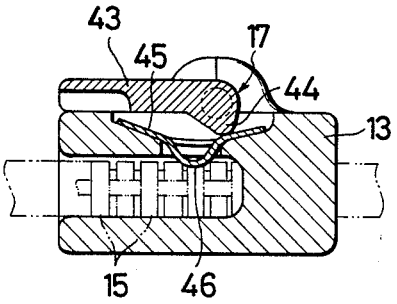
FIG. 31 is a cross-sectional view of the locking mechanism with parts in a locking position.
Figure 32:
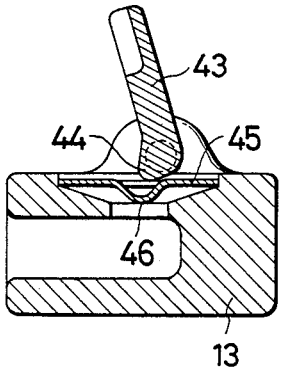
FIG. 32 is a view similar to FIG. 31, but showing the locking mechanism with parts in an unlocking position.

Another modified slider lock mechanism 17 shown in FIGS. 30 through 32 is a semi-autolock type including a pivotable cam lock 43 pivotally connected at one end to the body of a slider 13 for resiliently deforming a resilient locking strip 45 to releasably lock the slider 13 in position against movement relative to the coupling elements 15. The locking strip 45 is resiliently deformably disposed the slider body and has a downwardly projecting central locking prong 46. The cam lock 43 has an integral cam 44 engageable with the resilient locking strip 45 to move the locking prong 46 into and out of interlocking engagement with one of the coupling elements 15. The cam lock 43 is movable between a recumbent locking position shown in FIG. 31 in which the cam 44 urges the resilient locking strip 45 to bent or flex downwardly to thereby move the locking prong 46 into interlocking engagement with the coupling element 15, and a tilted releasing position shown in FIG. 32 in which the cam 44 allows the resilient locking strip 45 to unbent or restore its original shape to thereby disengage the locking prong 46 from the coupling element 15.

Figure 33:
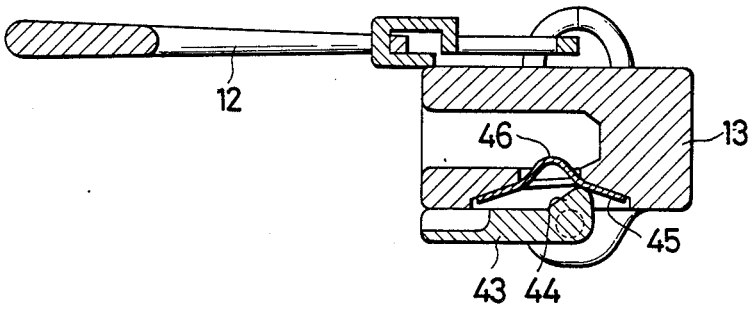
FIG. 33 is a cross-sectional view of another slider in which the locking mechanism of FIG. 30 is incorporated.

The cam lock mechanism 43 may be mounted on the underside of the slider body as shown in FIG. 33. In this instance, an ornamental pull tab 12 is connected to the upper plate of the slider body.

Figure 34:
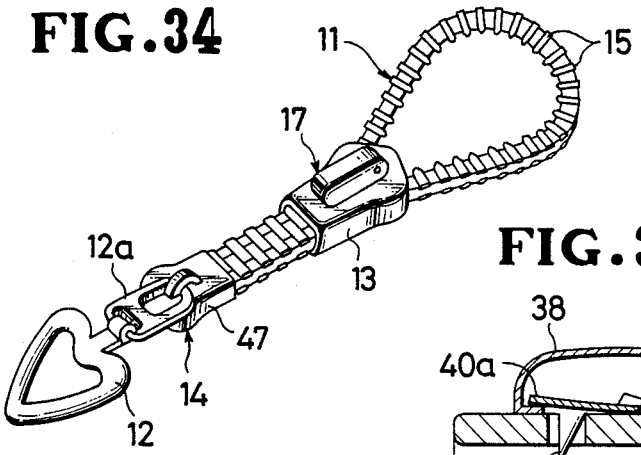
FIG. 34 is a perspective view of a key holder having a modified end stop.
Figure 35:
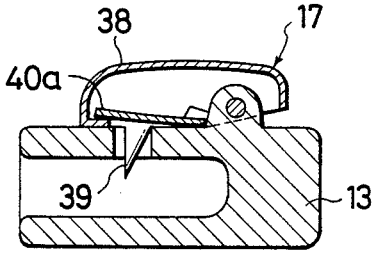
FIG. 35 is an enlarged cross sectional view of a slider locking mechanism associated with a slider of the key holder shown in FIG. 34.
Figure 36:
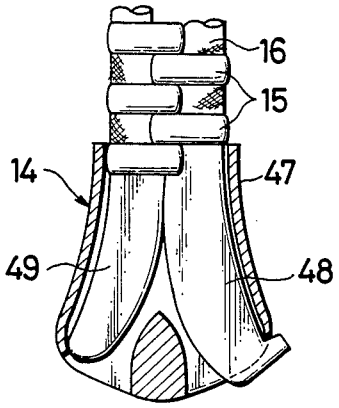
FIG. 36 is an enlarged front elevational view, with part in cross section, of the end stop shown in FIG. 34.
Figure 37:
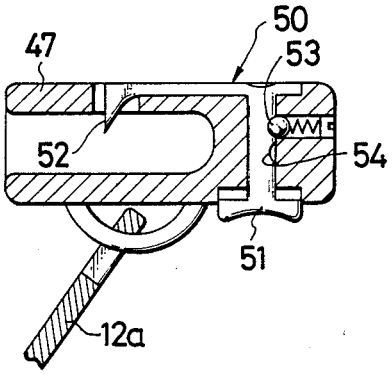
FIG. 37 is a cross-sectional view of a lockable slider forming a part of the modified end stop.

FIG. 34 shows a key holder which is substantially the same as the key holder 10 shown in FIG. 1 but differs therefrom in that there is provided a modified form of the separable end stop. The modified end stop 14 includes, as shown in FIG. 36, an auxiliary slider 47 disposed in tail-to-tail confrontation with a main slider 13, a curved retainer pin 48 secured to one of opposite ends of a holding strap 11 and having a lateral projection (not designated) engageable with the auxiliary slider 47 to hold the same against detachment from the holding strap 11, and a curved separable pin 49 secured to the other end of the holding strap 11 and releasably receivable in the auxiliary slider 47. With the auxiliary slider 47 thus provided, the interengaged coupling elements 15 can be disengaged or separated from the separable end stop 14 by moving the auxiliary slider 47 in a direction toward the main slider 13. The main slider 13 may includes a slider lock mechanism 17 of the autolock type which comprises, as shown in FIG. 35, a pivotable cover 38 with a locking prong 39, and a leaf spring 40*a* acting between the slider body and the cover 38 to urge the latter in a direction to move the locking prong 39 into interlocking engagement with one of the coupling elements. The slider lock mechanism 17 of this type is disclosed in Japanese utility Model Publication No. 49-43446. Likewise, the auxiliary slider 47 may include a slider lock mechanism of the manual type which comprises, as shown in FIG. 37, an L-shaped locking bolt 51 having a presser head (not designated) at an outer end of one arm of the L-shaped locking bolt 51, and a locking prong 52 at an outer end of the other arm of the L-shaped locking bolt 51. The locking bolt 51 is reciprocably movable between an locking position in which the locking prong 52 projects into the slider 47 for interlocking engagement with the coupling element, and a releasing position in which the locking prong 52 is disengaged from the coupling element, thereby releasing the slider 47. The reciprocating movement of the locking bolt 51 is limited by a predetermined extent by a detent means composed of a spring-viased locking ball 53 releasably receivable in one of two spaced retainer recesses 54 formed in the locking bolt 51.

Figure 38:
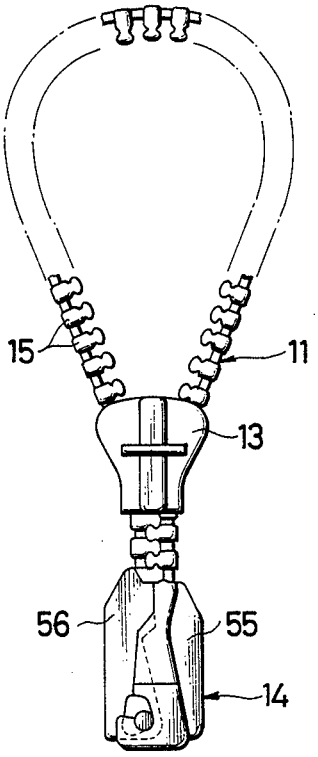
FIG. 38 is a front elevational view of a key holder having a hinged separable end stop.
Figure 39:
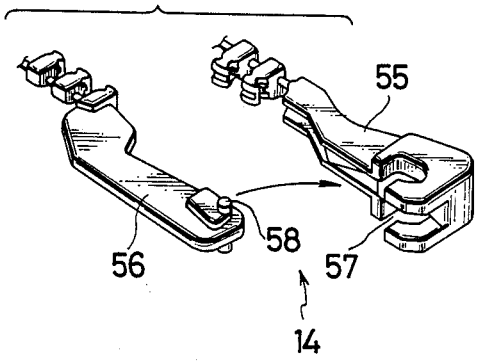
FIG. 39 is an enlarged perspective view of the hinged separable end stop as it is in a separated condition.
Figure 40:
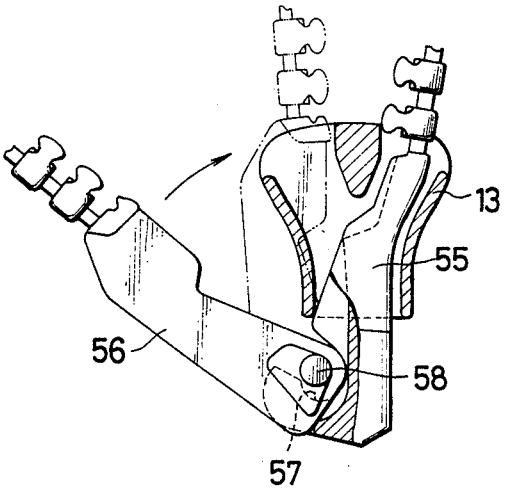
FIG. 40 is a front elevational view illustrative of the operation of the hinged separable end stop.

Another modified form of the end stop 14 illustrated in FIGS. 38 through 40 comprises a hinged separable end stop which is composed of a retainer pin 55 secured to one of opposite ends of a holding strap 11 and having shape capable of retaining a slider 13, and a separable pin 56 secured to the other end of the holding strap 11 and detachably connected to the retainer pin 55 by means of a hinge. To this end, the retainer pin 55 has a retaining recess 57 opening laterally inwardly and the separable pin 56 includes a hinge pin 58 releasably receivable in the retainer recess 57.

Figure 23:
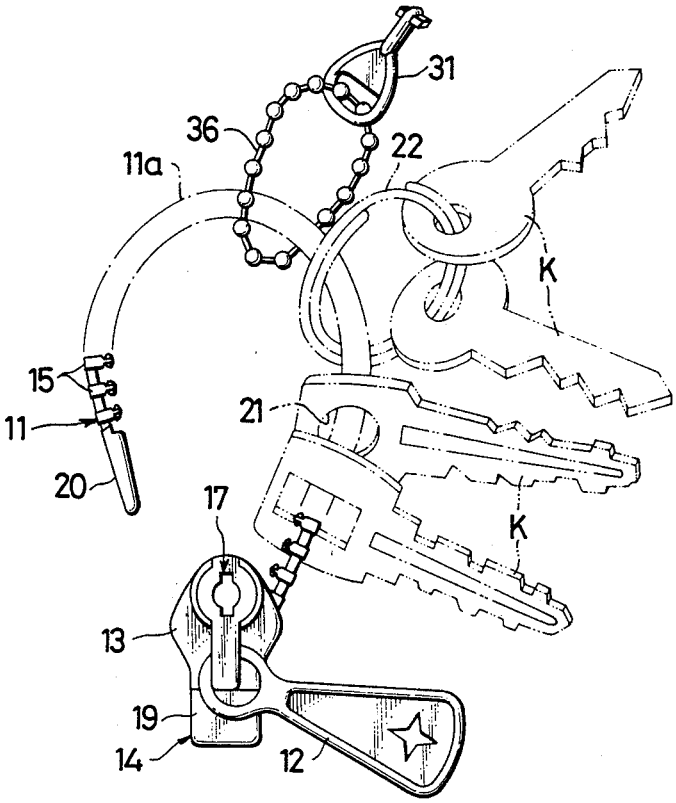
FIG. 23 is a front elevational view showing the manner in which the key holder operates.
Figure 41:
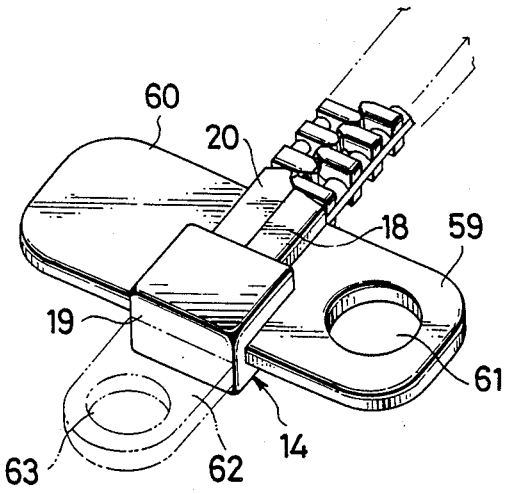
FIG. 41 is a perspective view of a modified end stop having grip tabs.
Figure 42:
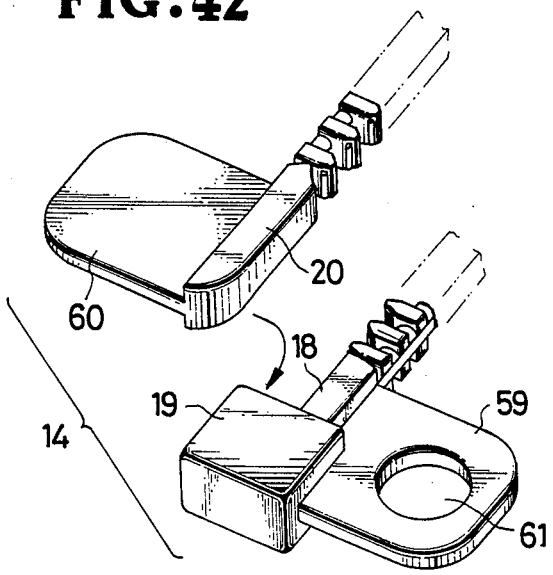
FIG. 42 is a view similar to FIG. 41, showing the operation of the end stop.

FIGS. 22 and 23 show another end stop of the separable type which is substantially the same as the separable end stop 14 shown in FIG. 1 with the exception that a pair of grip tabs 59, 60 is formed integrally with the retainer and separable pins 18, 20, respectively, for facilitating the handling of the key holder. The grip tab 59 has a central hole 61 used when hanging the key holder on a hook, for example. The grip tabs 59, 60 may be replaced by a single grip tab 62 (indicated by phantom lines in FIG. 41) formed integrally with the retainer box 19, the grip tab 62 having a central hole 63 provided for purposes of storage of the key holder.

Figure 43:
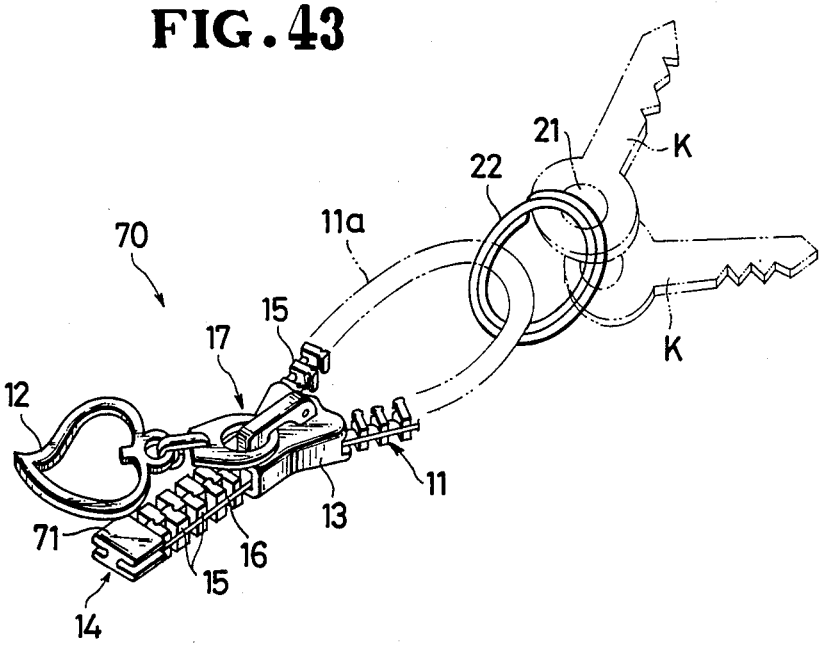
FIG. 43 is a perspective view of a modified key holder according to the present invention.
Figure 44:
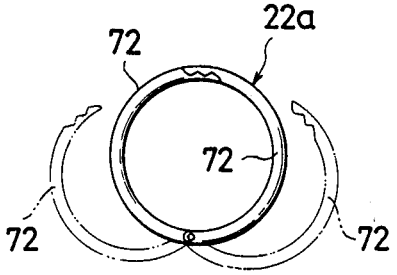
FIG. 44 is a front elevational view of a key ring.
Figure 45:
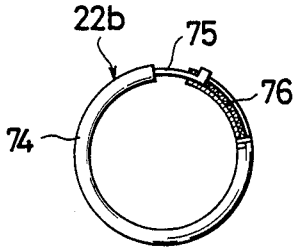
FIG. 45 is a front elevational, partly cross-sectional view of a modified key ring.

A key holder 70 shown in FIG. 43 is similar to the key holder shown in FIG. 24 but differs therefrom in that the end stop 14 is composed of a one-piece end stop member 71 of a horizontal H-shape secured to a holding strap 11 across opposite end thereof to firmly connect the opposite ends of the holding strap 11. Another difference is that the keys K are threaded over a split key ring 22 which in turn is threaded over the holding strap 11. The split key ring 22 may be replaced with a card ring 22*a* (FIG. 44) having a pair of hinged arcuate arms 72, 72 interlockingly engageable together to complete a circular shape. Another alternative form of the split key ring 22 comprises a bolt ring 22*b* (FIG. 45) including a tube 74 of an interrupted circular shape, a tongue 75 movably disposed in an end of the tube 74, and a compression coil spring 76 disposed in the tube 74 and acting between the tube 74 and the tongue 75 for urging the latter to project into the opposite end of the tube 74.

Figure 46:
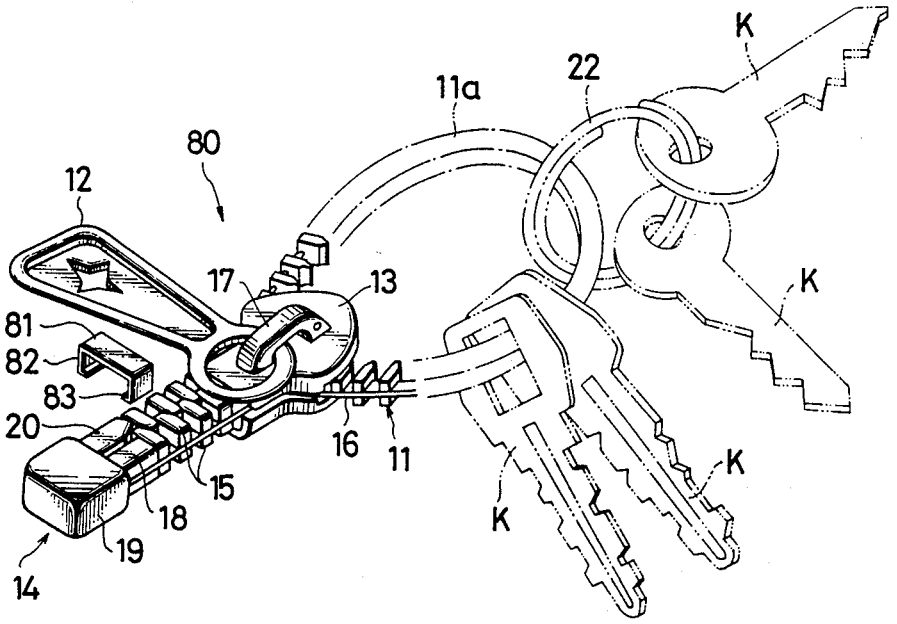
FIG. 46 is a modified key holder having a slider stopper according to the present invention.

FIG. 46 shows a key holder 80 substantially the same as the key holder 10 of the foregoing embodiment shown in FIGS. 1 through 5, excepting that the movement of the slider 13 in a direction toward the separable end stop 14 is limited by a stopper 81 mounted on the end stop 14 astride the retainer and separable pin 18, 20. The stopper 81 is formed of a resilient strip of metal or synthetic resin and bent into a generally horizontal C-shape having a pair of laterally spaced resilient legs 82 each having a locking foot 83 projecting laterally inwardly toward the locking foot 83 on the opposite resilient leg 83.

Figure 47:
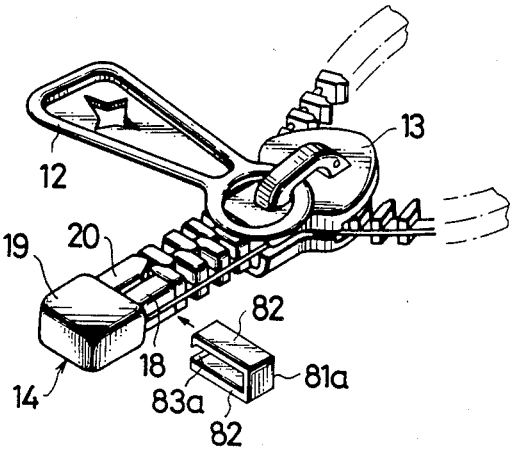
FIG. 47 is a fragmentary perspective view of a key holder having a modified slider stopper.
Figure 48:
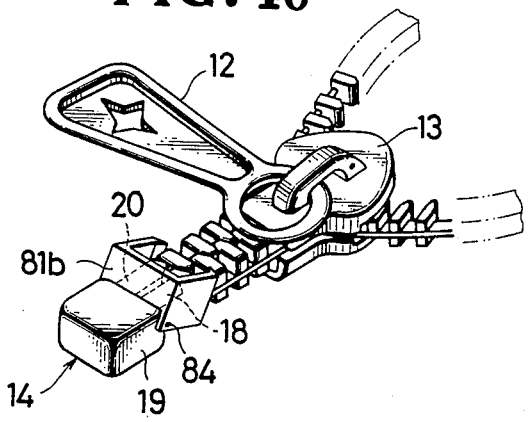
FIG. 48 is a view similar to FIG. 47, but showing another modified slider stopper.
Figure 49:
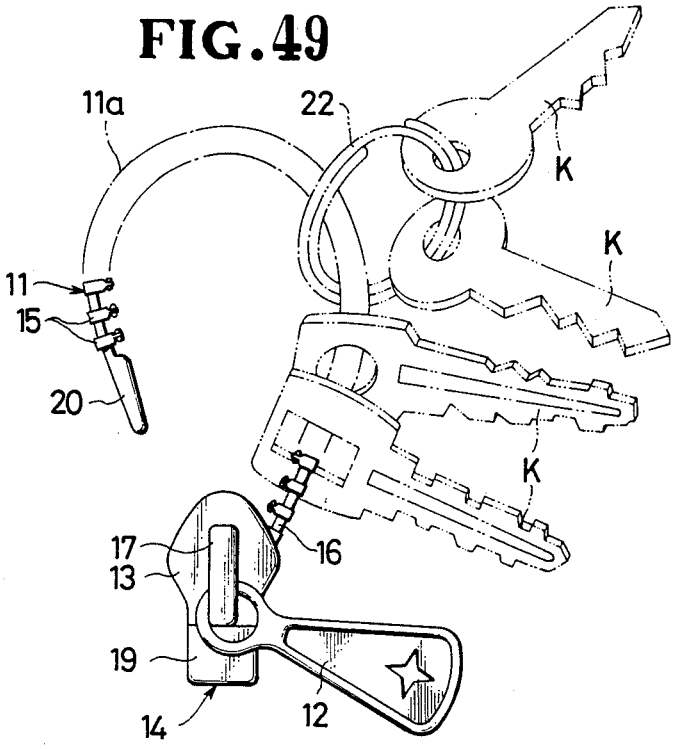
FIGS. 49 and 50 are front elevational views illustrative of the operation of the key holder shown in FIG. 46.
Figure 50:
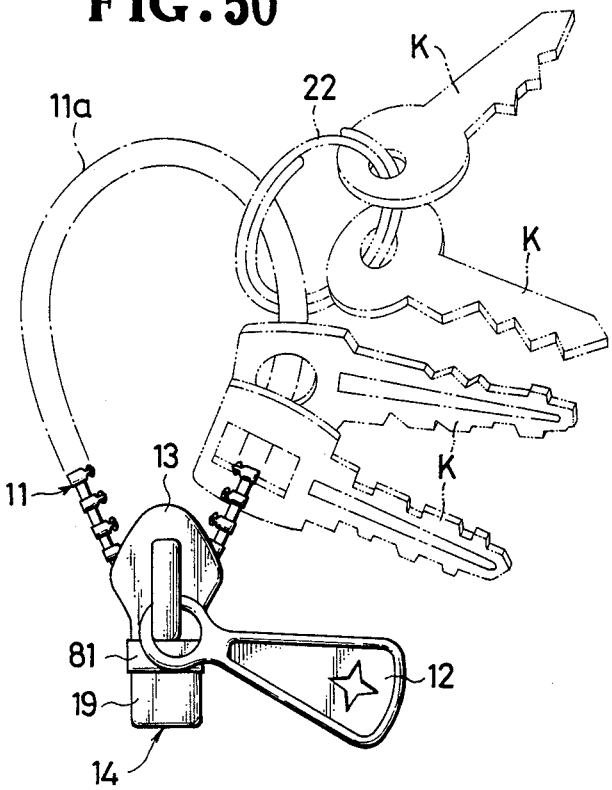
Figure 51:
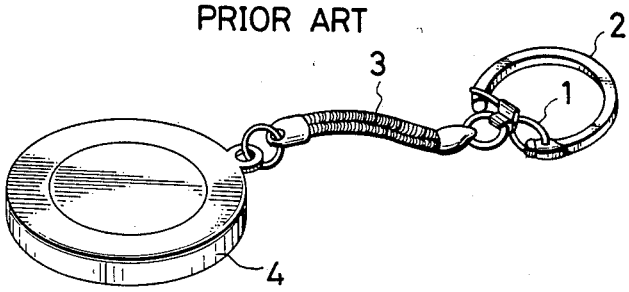
FIG. 51 PRIOR ART
FIG. 51 is a perspective view of a conventional key holder.

In use, a holding strip 11 of the key holder 80 is threaded through the key holes in the respective keys K and through the split key ring 22 connected to keys K, as shown in FIG. 49 and then bent into a closed loop 11*a* by inserting the separable pin 20 through the slider 13 into the retainer box 19 of the end stop 14. After the slider 13 is moved in a direction away from the end stop 14 for contracting or reducing the loop 11*a* of the holding strap 11, the stopper 81 is snap-fitted to the end stop 14 astride the retainer and separable pins 18, 20, as seen from FIG. 46. With the stopper 81 thus provided, the movement of the slider 13 toward the end stop 14 terminates upon abutment with the stopper 81, as shown in FIG. 50, so that an accidental removal of the separable pin 20 from the retainer box 19 can be prevented. FIG. 47 shows a modified stopper 81*a* having a horizontal U-shape and adapted to be mounted on the end stop 14 by being fitted sideways successively over the retainer pin 19 and over the separable pin 20 until the respective locking feet 83*a* lockingly engage the separable pin 20. As an alternative, the stopper may comprises a pivotable stopper 81*b* connected to the retainer box 19 by a pair of coaxial pivot pins 84 (only one shown). The pivotable stopper 81*b* is angularly movable about the pivot pins 84 between a horizontal working position to prevent movement of the slider 13 toward the end stop 14, and tilted standby position to allow the slider 13 to engage the end stop 14.

Obviously, various modifications and variations of the present invention are possible in the light of the above teaching. It is therefore to be understood that within the scope of the appended claims the invention may be practiced otherwise than as specifically described.

What is claimed is:

1. A key holder comprising:

(a) a holding strap composed of a row of coupling elements attached to a flexible core cord at equal intervals along the entire length of said core cord, said core cord being smaller than the width of said row of coupling elements, each said coupling element having a coupling head which is symmetric in shape about a longitudinal axis of said coupling element;

(b) an end stop mounted across opposite ends of said holding strap for connecting them while keeping said holding strap bent into a closed loop with the respective coupling heads of said coupling elements directed inwardly of said looped holding strap; and (c) a slider slidably mounted on and movable along opposed ones of the coupling elements for taking them into and out of interdigitating engagement to contract and expand said loop of 2. A key holder comprising:

(a) a holding strap composed of a row of coupling elements attached to a flexible core, each said coupling element having a coupling head which is symmetric in shape about a longitudinal axis of said coupling element;

(b) an end stop mounted across opposite ends of said holding strap for connecting them while keeping said holding strap bent into a closed loop with the respective coupling heads of said coupling elements directed inwardly of said looped holding strap; and (c) a slider slidably mounted on and movable along opposed ones of the coupling elements for taking them into and out of interdigitating engagement to contract and expand said loop of the holding strap, said end stop being of the separable type comprising a retainer pin secured to one of opposite ends of said holding strap and having a retainer box connected thereto, and a separable pin secured to the other end of said holding strap and releasably receivable in said box for releasably connecting said opposite ends of the holding strap.

3. A key holder comprising:

(a) a holding strap composed of a row of coupling elements attached to a flexible core cord, each said coupling element having a coupling head which is symmetric in shape about a longitudinal axis of said coupling element;

(b) an end stop mounted across opposite ends of said holding strap for connecting them while keeping said holding strap bent into a closed loop with the respective coupling heads of said coupling elements directed inwardly of said looped holding strap; and (c) a slider slidably mounted on and movable along opposed ones of the coupling elements for taking them into and out of interdigitating engagement to contract and expand said loop of the holding strap, said end stop being of the separable type comprising an auxiliary slider slidably mounted on the opposed coupling elements in tail-to-tail confrontation to said slider, a retainer pin secured to one of opposite ends of said holding strap and capable of retaining thereon said auxiliary slider, and a separable pin secured to the other end of said holding strap and releasably receivable in said auxiliary slider.

4. A key holder according to claim 3, said auxiliary slider including a lock mechanism for releasably locking said auxiliary slider in position against movement relative to said row of coupling elements.

5. A key holder according to claim 4, said lock mechanism comprising an L-shaped locking bolt reciprocally mounted in a body of said slider and having a locking prong movable into and out of interlocking engagement with one of said coupling elements in response to reciprocating movement of said locking bolt, and detent means for limiting the reciprocating movement of said locking bolt within a predetermined range.

6. A key holder according to claim 4, said auxiliary slider further including a pull tab pivotally connected to a body of said auxiliary slider.

7. A key holder according to claim 6, said pull tab being disposed on a side which is opposite to the side on which said lock mechanism is provided.

8. A key holder comprising:

(a) a holding strap composed of a row of coupling elements attached to a flexible core cord, each said coupling element having a coupling head which is symmetric in shape about a longitudinal axis of said coupling element;

(b) an end stop mounted across opposite ends of said holding strap for connecting them while keeping said holding strap bent into a closed loop with the respective coupling heads of said coupling elements directed inwardly of said looped holding strap; and (c) a slider slidably mounted on and movable along opposed ones of the coupling elements for taking them into and out of interdigitating engagement to contract and expand said loop of the holding strap, said end stop being of the separable type comprising a retainer pin secured to one of opposite ends of said holding strap and capable of retaining thereon said slider, a separable pin secured to the other end of said holding strap, and hinge means for detachably and pivotally connecting said retainer and separable pins.

9. A key holder according to claim 8, said hinge means comprising a recessed portion of said retainer pin, and a hinge pin mounted on said separable pin and releasably receivable in said recessed portion in said retainer pin.

10. A key holder according to claim 1, said end stop being of the fixed type comprising a one-piece end stop member firmly secured to said holding strap across said opposite ends of the holding strap.

11. A key holder comprising:

(a) a holding strap composed of a row of coupling elements attached to a flexible core cord, each said coupling element having a coupling head which is symmetric in shape about a longitudinal axis of said coupling element;

(b) an end stop mounted across opposite ends of said holding strap for connecting them while keeping said holding strap bent into a closed loop with the respective coupling heads of said coupling elements directed inwardly of said looped holding strap; and (c) a slider slidably mounted on and movable along opposed ones of the coupling elements for taking them into and out of interdigitating engagement to contract and expand said loop of the holding strap, said end stop being of the separable type, further including a stopper detachably mounted on said separable end stop for limiting the movement of said slider toward said separable end stop.

12. A key holder according to claim 11, said separable end stop including a retainer pin secured to one of opposite ends of said holding strap and a separable pin secured to the opposite end of said holding strap, said stopper being formed of a strip of resilient material bent into a horizontal C-shape, said resilient stopper being snap-fitted to said separable end stop astride said retainer and separable pins.

13. A key holder according to claim 11, said separable end stop including a retainer pin secured to one of opposite ends of said holding strap and a separable pin secured to the opposite end of said holding strap, said stopper being formed of a strip of resilient material bent into a horizontal U-shape, said resilient stopper being snappingly fitted sideways successively over one of said retainer and separable pins and over the other of said retainer and separable pins.

14. A key holder according to claim 11, said separable end stop including a retainer pin secured to one of opposite ends of said holding strap and having a retainer box connected thereto, and a separable pin secured to the opposite end of said holding strap and releasably receivable in said retainer box, said stopper being formed of a strip of resilient material bent into a horizontal C-shape and pivotally connected to said retainer box, said stopper being movable between a horizontal position to snappingly fit with the retainer and separable pins to thereby prevent the movement of the slider toward said retainer box, and a tilted position to allow said slider to move into abutment with the retainer box.

15. A key holder according to claim 1, said slider including a lock mechanism for releasably locking said slider in position against movement relative to said row of coupling elements.

16. A key holder according to claim 15, said lock mechanism being of the key-lockable type comprising a key, a cylinder rotatably mounted on said slider and having a keyhole for receiving therein said key and a cam surface, a locking strip having a locking prong at an end thereof, and a compression coil spring acting between said slider and an opposite end of said locking strip for urging the latter against said cam surface, said cam surface, upon rotation of said cylinder, being operative to cause said locking strip to pivot about said cam surface to thereby move said locking prong into and out of interlocking engagement with said one coupling element, said key being connected with a key chain threaded over said holding strap.

17. A key holder according to claim 15, said lock mechanism being of the autolock type comprising a cover pivotally mounted on said slider and having a locking prong at its an end, and a spring acting between said slider and said cover for urging the latter in a direction to move said locking prong into interlocking engagement with said one coupling element.

18. A key holder according to claim 15, said lock mechanism being of the autolock type comprising a manually operated unlock knob reciprocally movably mounted on said slider, a locking strip having a locking prong at an end thereof, and a compression coil spring acting between said slider and an opposite end of said locking strip to urge the latter against said unlock knob, said unlock knob and said locking strip being formally urged by said spring in a direction to move said locking prong into interlocking engagement with said one coupling element.

19. A key holder according to claim 15, said lock mechanism being of a semi-autolock type comprising a resilient locking strip resiliently deformably disposed in said slider and having a locking projection, and a cam lock pivotally connected to said slider and having a cam engageable with said locking strip and resiliently flexing said locking strip in a direction to urge said locking prong into interlocking engagement with said one coupling element in response to angular movement of said cam lock.

20. A key holder according to claim 15, said lock mechanism being disposed on one side of the slider, said pull tab being disposed on an opposite side of said slider.

* * * * *